US012523050B2

(12) United States Patent
Akita et al.

(10) Patent No.: US 12,523,050 B2
(45) Date of Patent: Jan. 13, 2026

(54) ANCHOR SUPPORT TOOL AND FORM SET FOR FOUNDATION

(71) Applicant: Sekisui House, Ltd., Osaka (JP)

(72) Inventors: Sachi Akita, Osaka (JP); Kazuki Ichikawa, Osaka (JP); Toshiyuki Osada, Osaka (JP); Yoshiyuki Matsubara, Osaka (JP); Kentarou Kaneyasu, Osaka (JP); Hideki Watanabe, Osaka (JP)

(73) Assignee: Sekisui House, Ltd., Osaka (JP)

( * ) Notice: Subject to any disclaimer, the term of this patent is extended or adjusted under 35 U.S.C. 154(b) by 139 days.

(21) Appl. No.: 18/562,965

(22) PCT Filed: May 31, 2021

(86) PCT No.: PCT/JP2021/020714
§ 371 (c)(1),
(2) Date: Nov. 21, 2023

(87) PCT Pub. No.: WO2022/254533
PCT Pub. Date: Dec. 8, 2022

(65) Prior Publication Data
US 2024/0263466 A1 Aug. 8, 2024

(51) Int. Cl.
*E04G 21/18* (2006.01)
*E02D 27/00* (2006.01)

(52) U.S. Cl.
CPC ..... *E04G 21/18* (2013.01); *E02D 27/00* (2013.01); *E02D 2250/0007* (2013.01); *E02D 2600/30* (2013.01)

(58) Field of Classification Search
CPC . E04G 21/18; E02D 27/00; E02D 2250/0007; E02D 2600/30
See application file for complete search history.

(56) References Cited

U.S. PATENT DOCUMENTS 7,445,192 B2 * 11/2008 Gridley ..... E04B 1/4157 249/207

FOREIGN PATENT DOCUMENTS

| | | | |
|---|---|---|---|
| GB | 2 617 933 | A | 10/2023 |
| JP | S54-128304 | U | 9/1979 |
| JP | S58-25346 | A | 2/1983 |
| JP | S58-25346 | U | 2/1983 |
| JP | S58-179357 | U | 11/1983 |
| JP | 2003-090049 | A | 3/2003 |
| JP | 2011-236665 | A | 11/2011 |

(Continued)

OTHER PUBLICATIONS

British Examination Report dated Aug. 1, 2024, in connection with British Application No. GB 2316789.3.

(Continued)

*Primary Examiner* — Kyle Armstrong
(74) *Attorney, Agent, or Firm* — Wolf, Greenfield & Sacks, P.C.

(57) ABSTRACT

This anchor support tool supports an anchor provided in a foundation, the anchor support tool comprising: a support plate having at least one support part for supporting an anchor; a spacer for positioning the support plate with respect to a form of the foundation in the height direction; and a fixing jig for fixing the support plate to the form. The fixing jig supports the support plate while the support plate is disposed above the form with the spacer therebetween.

9 Claims, 14 Drawing Sheets

(56) References Cited

FOREIGN PATENT DOCUMENTS

| | | | |
|---|---|---|---|
| JP | 2018-031179 | A | 3/2018 |
| JP | 2018-199946 | A | 12/2018 |

OTHER PUBLICATIONS

International Search Report and Written Opinion dated Aug. 24, 2021, in connection with International Application No. PCT/JP2021/020714.

* cited by examiner

ANCHOR SUPPORT TOOL AND FORM SET FOR FOUNDATION

CROSS REFERENCE TO RELATED APPLICATIONS

This Application is a national stage filing under 35 U.S.C. 371 of International Patent Application Serial No. PCT/JP2021/020714, filed May 31, 2021, entitled "ANCHOR SUPPORT TOOL AND FORM SET FOR FOUNDATION." The entire content of this application is incorporated herein by reference in its entirety.

TECHNICAL FIELD

The present invention relates to an anchor support that supports anchors on the foundation of a building and a formwork set for the foundation.

BACKGROUND

In a known technique, anchors are each arranged at a predetermined position during construction of the foundation of a building. Patent Literature 1 discloses a base plate that supports anchors on the formwork of rising portions in a foundation. The base plate is arranged to extend between two frame plates that are located on opposite sides of rising portions.

CITATION LIST

Patent Literature

Patent Literature 1: Japanese Laid-Open Patent Publication No. 2003-90049

SUMMARY OF INVENTION

Technical Problem

In the foundation of a building having no rising portions, anchors are arranged along the outer surface of the foundation. In the construction of the foundation, the anchors are supported by a support plate or a pole configured to be fixed to a formwork. The support plate or the pole may be fixed to the formwork using a spacer. However, the support plate is only fixed at its end to a frame plate. This may cause the support plate to flex due to the weight of the anchors and thus lower the position accuracy of the anchors. It is an objective of the present invention to provide an anchor support and a formwork set for the foundation of a building that improve the position accuracy of anchors.

Solution to Problem (1) An anchor support that solves the problem supports an anchor configured to be arranged on a foundation. The anchor support includes a support plate including at least one support portion that supports the anchor, a spacer that positions the support plate relative to a formwork of the foundation in a height direction, and a fixing jig that fixes the support plate to the formwork. The fixing jig supports the support plate in a state in which the support plate is arranged on the formwork with the spacer located in between.

If the support plate is fixed to the formwork only using a screw and the anchors are attached to the support plate, the weights of the anchors may cause the support plate to flex.

This lowers the position accuracy of the anchors. In this respect, the support plate is supported by the fixing jig and fixed to the formwork. When the anchors are attached to the support plate, the load on the anchors is applied to the fixing jig. This limits flexing of the support plate. As a result, the position accuracy of the anchors is improved in the foundation.

(2) In the anchor support according to the aspect (1), the fixing jig includes a body configured to be arranged along an outer surface of the formwork and fixed to the formwork and an arm that extends from the body and supports the support plate.

In this configuration, the support plate is supported by the arm extending from the body, which is configured to be fixed to the formwork. The arm supports a portion of the support plate that is separated from the formwork. This limits flexing of the support plate in the direction that is orthogonal to an inner surface of the formwork. This improves the position accuracy of the anchors.

(3) In the anchor support according to the aspect (2), the arm includes a fastening portion to which the support plate is fastened. In this configuration, the support plate is firmly fixed to the arm. This limits situations in which the support plate is detached from the arm by shaking of the foundation ground.

(4) In the anchor support according to the aspect (2) or (3), the arm includes a base portion configured to be connected to the body and a distal end on a side opposite to the base portion. The distal end is configured to be engaged with a second end of the support plate on a side opposite to a first end, the first end being configured to be fixed to the formwork.

In this configuration, when the support plate is supported by the fixing jig, the fixing jig is readily engaged with the support plate. This allows the support plate to be arranged in the formwork efficiently.

(5) In the anchor support according to the aspect (2) or (3), the arm includes a base portion configured to be connected to the body and a distal end on a side opposite to the base portion. The distal end is configured to be secured to a second end of the support plate on a side opposite to a first end using an engagement member, the first end being configured to be fixed to the formwork.

In this configuration, when the support plate is supported by the fixing jig, the fixing jig is readily engaged with the support plate using the engagement member. This allows the support plate to be arranged in the formwork efficiently.

(6) In the anchor support according to any one of the aspects (1) to (5), the support portion includes at least one anchor hole through which the anchor is inserted. In the support portion, the anchor hole is located at a predetermined position relative to a reference position of the support portion. In this configuration, each anchor is located at a predetermined position on the support plate. Thus, the anchor is arranged at a predetermined position with respect to the foundation ground simply by arranging the support plate at a predetermined position relative to the foundation ground and inserting the anchor into the anchor hole.

(7) In the anchor support according to any one of the aspects (1) to (6), the support portion of the support plate is one of support portions. The support portions of the support plate are spaced apart from each other by a predetermined distance.

This configuration allows multiple anchors to be each located at a predetermined position relative to the foundation ground using a single support plate.

(8) The anchor support according to any one of the aspects (1) to (7) further includes an additional support plate. The additional support plate includes a support portion that has the same structure as the support portion of the support plate. This configuration allows the number of the anchors supported by a single support plate to be increased as necessary.

(9) A formwork set for a foundation that solves the above problem includes the anchor support according to any one of the aspects (1) to (8). The formwork set includes the anchor support and thus limits flexing of the support plate. As a result, the position accuracy of the anchors is improved in the foundation.

Advantageous Effects of Invention

The anchor support and the formwork set for the foundation improve the position accuracy of the anchors in the foundation of the building.

MODES FOR CARRYING OUT THE INVENTION

A method for constructing a foundation 1 of a building, an anchor support 20, and a formwork set 15 will now be described with reference to FIGS. 1 to 21. In the present embodiment, the method for constructing the foundation 1 is applicable to the construction of a mat foundation. The method for constructing the foundation 1 is preferred for a foundation 1 that does not include rising portions (hereinafter referred to as the foundation 1).

Figure 1:
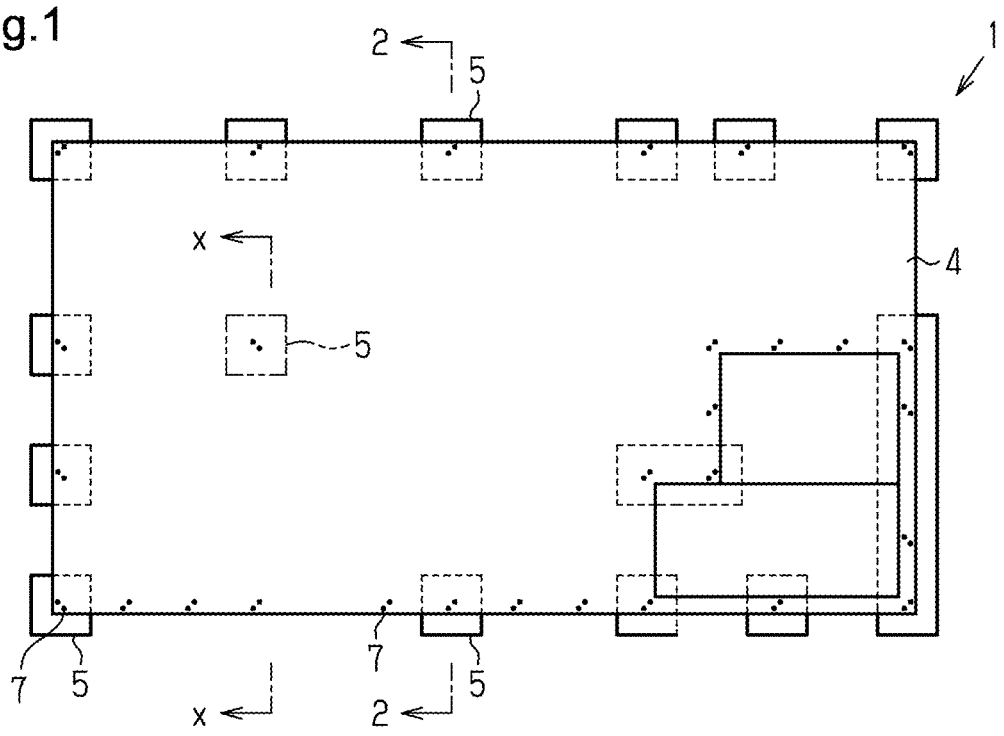
FIG. 1 is a plan view of a foundation.
Figure 2:
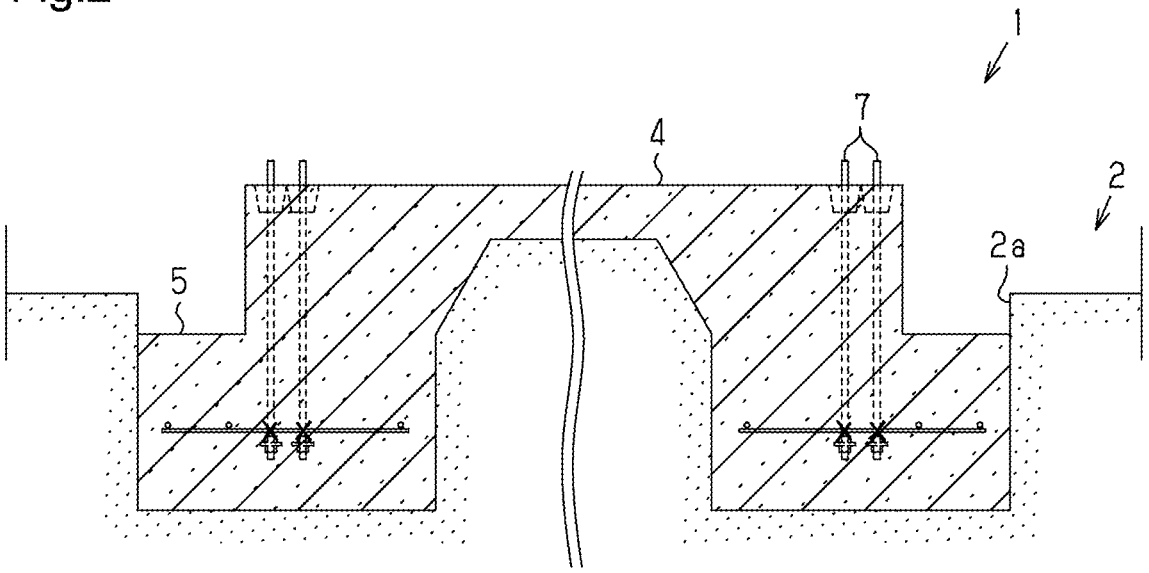
FIG. 2 is a cross-sectional view of the foundation taken along line 2-2 in FIG. 1.

As shown in FIGS. 1 and 2, the foundation 1 includes a base 4 and footings 5. The base 4 has a flat upper surface. Some footings 5 are located on a lower part of the outer surface of the base 4. Other footings 5 are located on a lower part of the middle portion of the base 4. Reinforcing bars 6 are arranged in the foundation 1. Anchors 7 are arranged upright on the foundation 1.

The method for constructing the foundation 1 of the building will now be described with reference to FIGS. 3 to 9. FIGS. 3 to 9 are diagrams each illustrating a corresponding step in the cross-section taken along line X-X in FIG. 1. The method for constructing the foundation 1 includes at least first to fifth steps. In the present embodiment, the method for constructing the foundation 1 further includes a sixth step and a seventh step. In the sixth and seventh steps, the footings 5 at the middle portion of the base 4 are formed.

Figure 3:
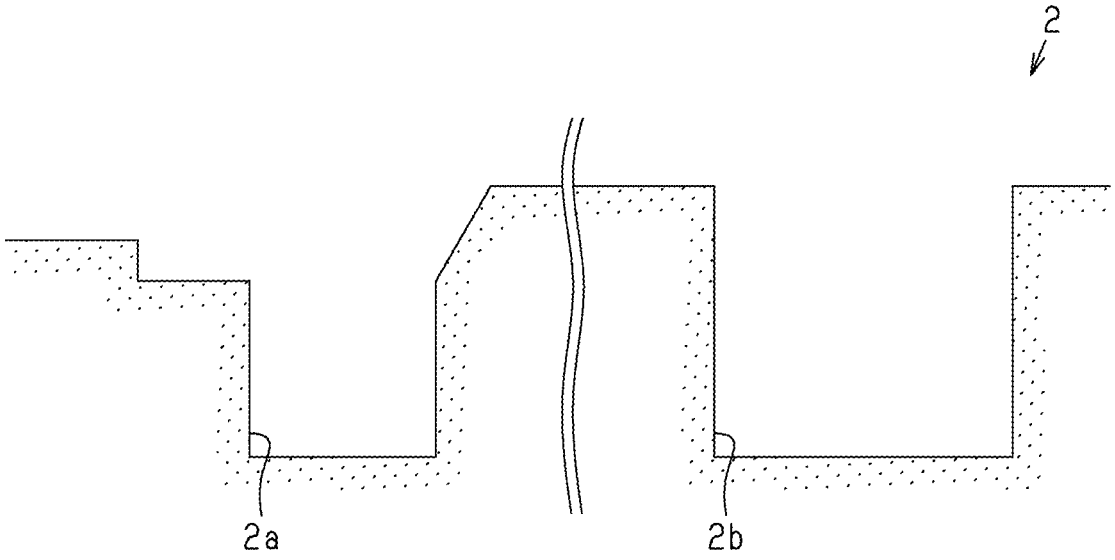
FIG. 3 is a cross-sectional view of the foundation in a first step.

As shown in FIG. 3, in the first step, a foundation ground 2 on which the foundation 1 is arranged is formed. The foundation ground 2 is formed by grading, excavation of a trench 2*a* and a hole 2*b*, and compaction. The foundation ground 2 is formed to conform to the shape of the foundation 1.

Figure 4:
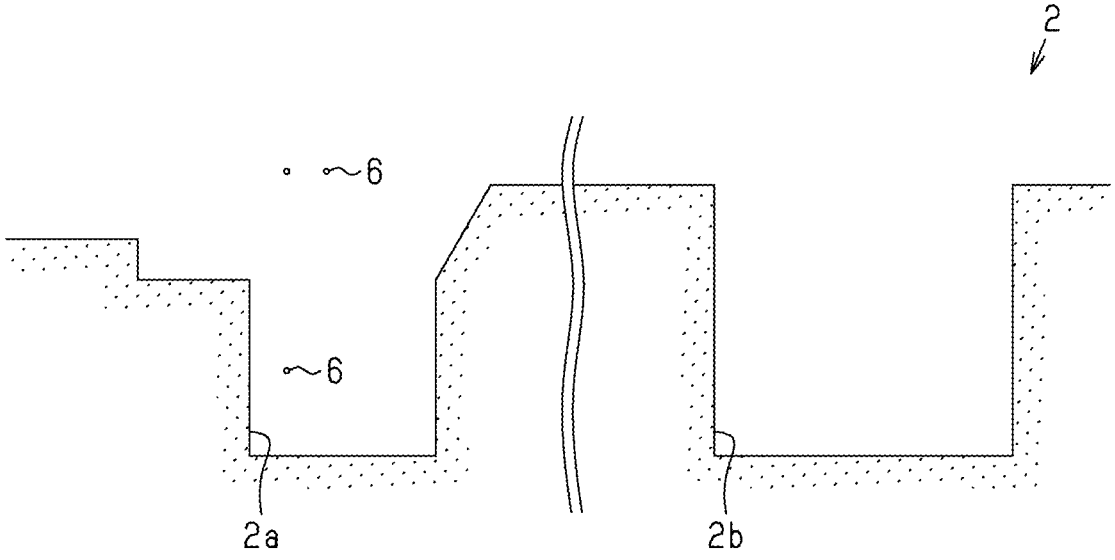
FIG. 4 is a cross-sectional view of the foundation in a second step.

As shown in FIG. 4, in the second step, the reinforcing bars 6 are placed on the foundation ground 2. The reinforcing bars 6 are arranged along the trench 2*a* of the foundation ground 2. The reinforcing bars 6 are also arranged on a portion corresponding to the base 4 of the foundation 1. Two reinforcing bars 6 adjacent to each other are coupled together using a binding wire.

Figure 5:
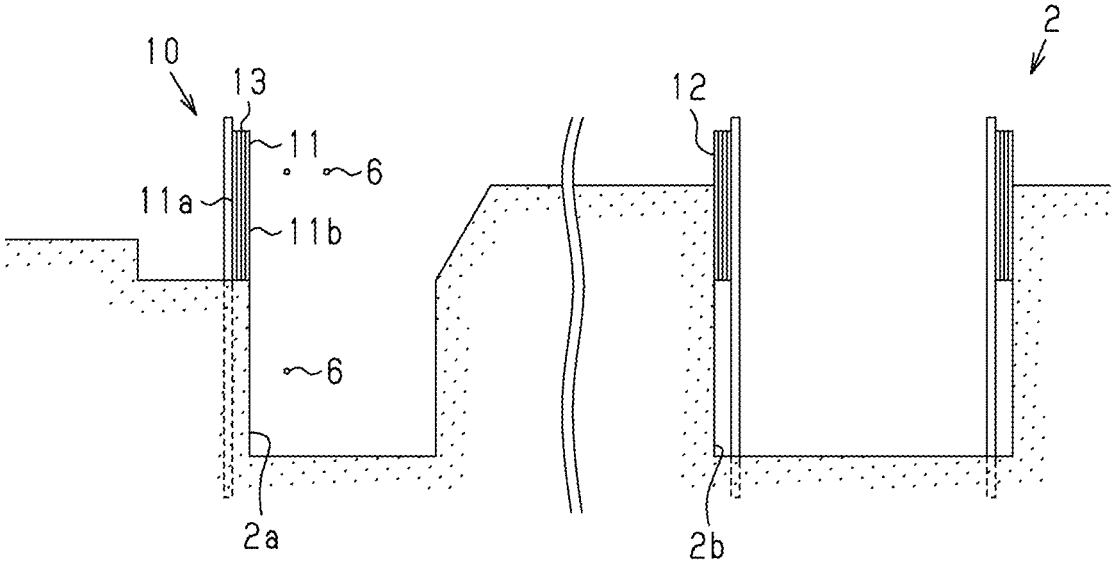
FIG. 5 is a cross-sectional view of the foundation in a third step.

As shown in FIG. 5, in the third step, a formwork 10 that forms the foundation 1 configured to be arranged on the foundation ground 2 is installed. The third step may be performed simultaneously with the second step. In the present embodiment, the formwork 10 includes an outer frame 11 and an inner frame 12. The outer frame 11 is installed to form the outer surface of the foundation 1. The inner frame 12 is located in the outer frame 11. The inner frame 12 is installed to form the footings 5 at the middle portion of the foundation 1. Specifically, the inner frame 12 is arranged along the inner surface of the hole 2*b* in the foundation ground 2.

Figure 6:
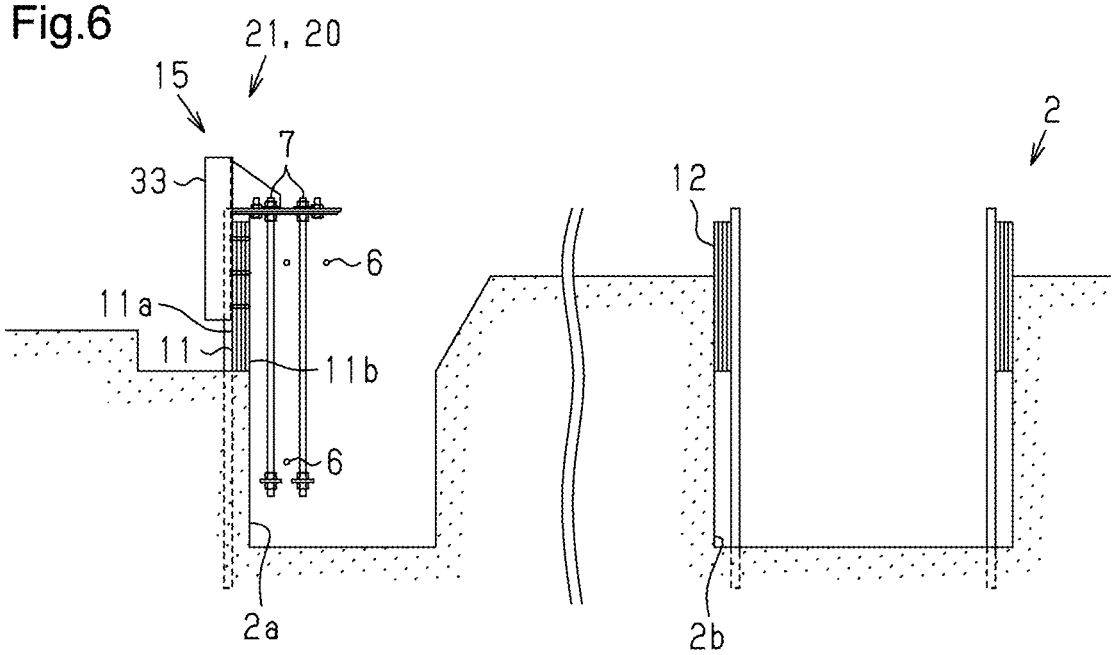
FIG. 6 is a cross-sectional view of the foundation in a fourth step.

As shown in FIG. 6, in the fourth step, multiple anchors 7 are arranged along the inner surface of the formwork 10. Specifically, the anchors 7 are arranged along the inner surface of the outer frame 11. The fourth step includes a task of installing the anchor support 20. In this task, the anchor support 20 is fixed to the formwork 10 such that a support portion 34 of the anchor support 20 is located at a position higher than the upper end surface 13 of the formwork 10. Then, the anchors 7 are suspended from the anchor support 20. The anchors 7 are supported by the anchor support 20.

In the fourth step, a first anchor support 21 and a second anchor support 22 are used as the anchor support 20. For example, the first anchor support 21 supports the anchors 7 arranged along a straight section of the formwork 10, which has a length of greater than or equal to two feet. The second anchor support 22 supports the anchors 7 at positions where the first anchor support 21 cannot be arranged.

In the present embodiment, the formwork 10 that includes the anchor supports 20 is referred to as the formwork set 15. The formwork set 15 includes the formwork 10 and one or more anchor supports 20. The formwork 10 is formed using a frame plate. The frame plate may be made of wood or metal.

Figure 7:
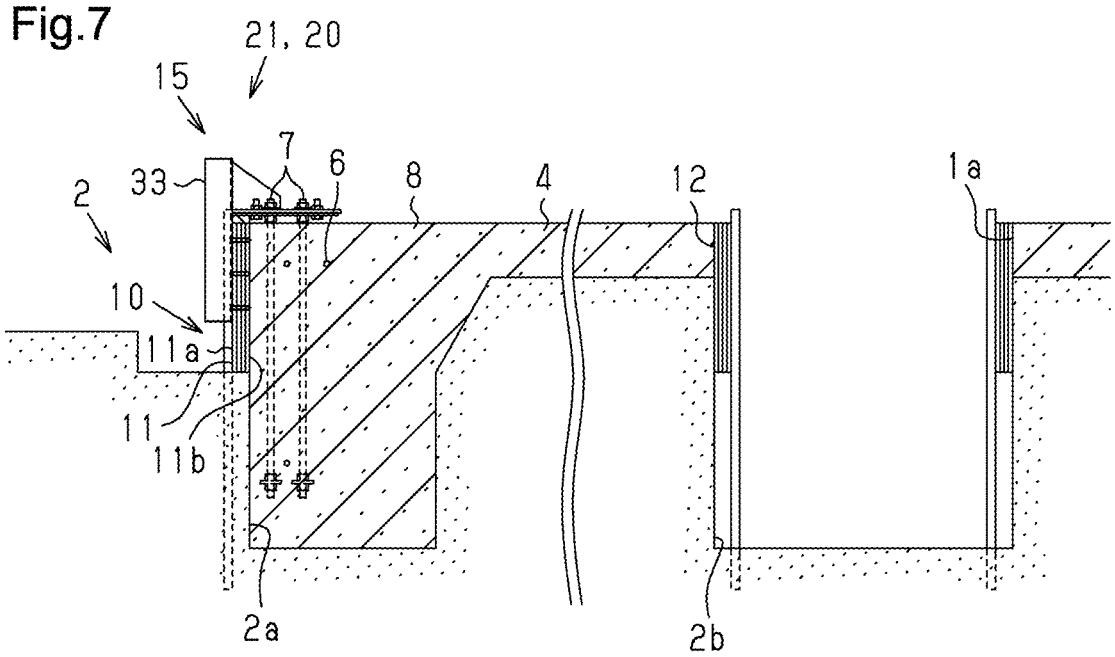
FIG. 7 is a cross-sectional view of the foundation in a fifth step.

As shown in FIG. 7, in the fifth step, concrete 8 is placed in the formwork 10. Specifically, the concrete 8 is placed in the space between the outer frame 11 and the inner frame 12. In the fifth step, the concrete 8 is leveled such that the upper surface of the concrete 8 is located at the same height as the upper end surface 13 of the formwork 10. The upper surface of the concrete 8 may be leveled using a leveling material. In the concrete 8 placed in the formwork 10, the upper surface of the concrete 8 is leveled using a trowel at the lower part of the support plate 30 of the first anchor support 21. In the concrete 8 placed in the formwork 10, the upper surface of the concrete 8 is leveled using a trowel at the lower part of the support plate 30 of the second anchor support 22.

Figure 8:
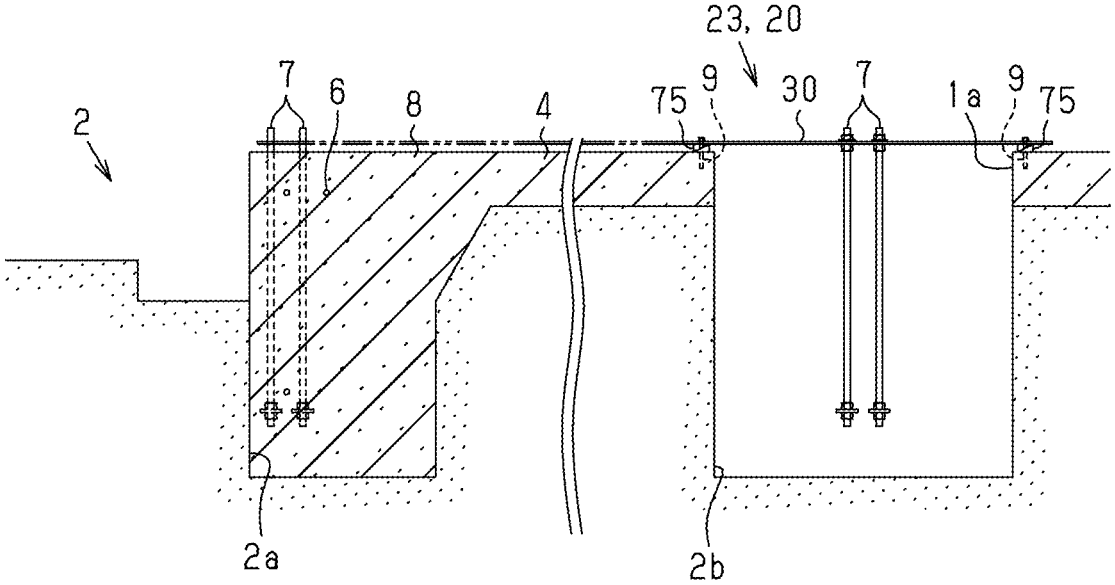
FIG. 8 is a cross-sectional view of the foundation in a sixth step.

As shown in FIG. 8, in the sixth step, each of the anchors 7 is arranged at a predetermined position in a foundation hole 1*a* that is formed by the inner frame 12. The sixth step includes a task of installing a third anchor support 23. In this task, the third anchor support 23 is installed on a portion around the foundation hole 1*a* such that the support portion 34 of the third anchor support 23 is located at a position higher than the upper surface of the surrounding portion of the foundation hole 1*a*.

Specifically, reference anchors 9 are each driven into a surrounding portion of the foundation hole 1*a* at a predetermined position so that the support plate 30 of the third anchor support 23 is arranged with reference to the reference anchors 9. In the sixth step, the support plate 30 of the third anchor support 23 may be arranged with reference to the anchors 7 arranged along the inner surface of the outer frame 11 (see the long dashed double-short dashed line in FIG. 8). After the installation of the third anchor support 23, the anchors 7 are suspended from the third anchor support 23. The third anchor support 23 supports the anchors 7.

Figure 9:
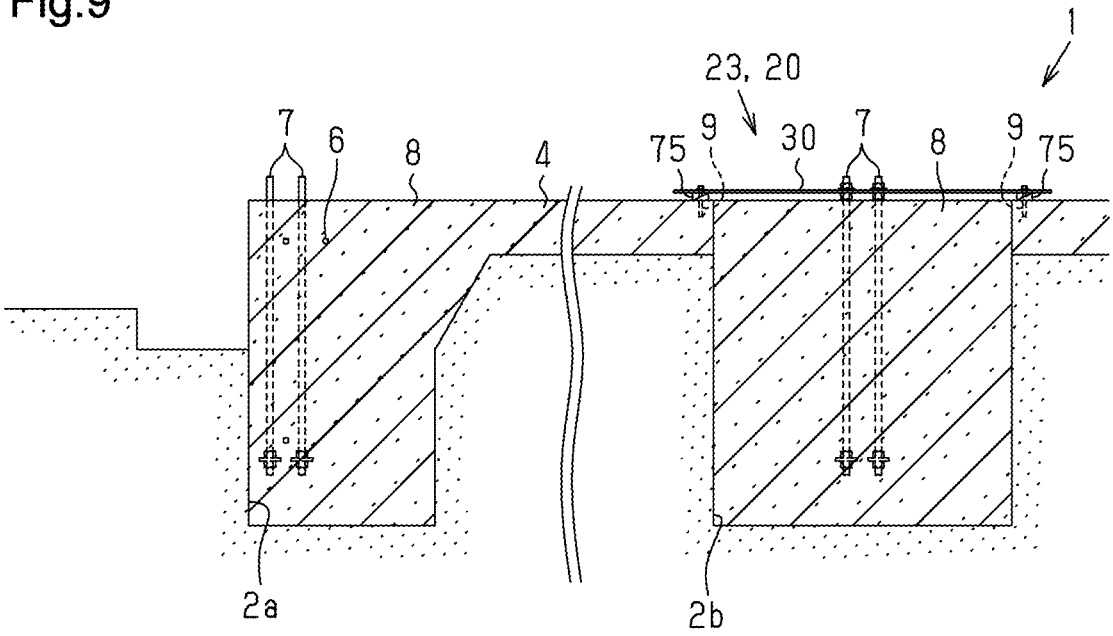
FIG. 9 is a cross-sectional view of the foundation in a seventh step.

As shown in FIG. 9, in the seventh step, the concrete 8 is placed in the foundation hole 1*a*. In this case, the concrete 8 is leveled such that the upper surface of the concrete 8 is located at the same height as the upper surface of the surrounding portion of the foundation hole 1*a*.

Anchor Support

The anchor support 20 will now be described with reference to FIGS. 10 to 21. The anchor support 20 supports the anchors 7 configured to be arranged on the foundation 1. Various types of anchor supports 20 may be used to construct the foundation 1. A suitable anchor support 20 is used depending on the location where the anchor 7 is arranged upright. In the present embodiment, the anchor support 20 includes the first anchor support 21 (see FIG. 17), the second anchor support 22 (see FIGS. 19 and 20), and the third anchor support 23 (see FIG. 8).

The first anchor support 21 is arranged on a straight section of the formwork 10 that has a length greater than or equal to that of the support plate 30 of the first anchor support 21. The second anchor support 22 is arranged on a portion of the formwork 10 where the first anchor support 21 cannot be arranged. The third anchor support 23 is arranged around the foundation hole 1*a*.

First Anchor Support

Figure 17:
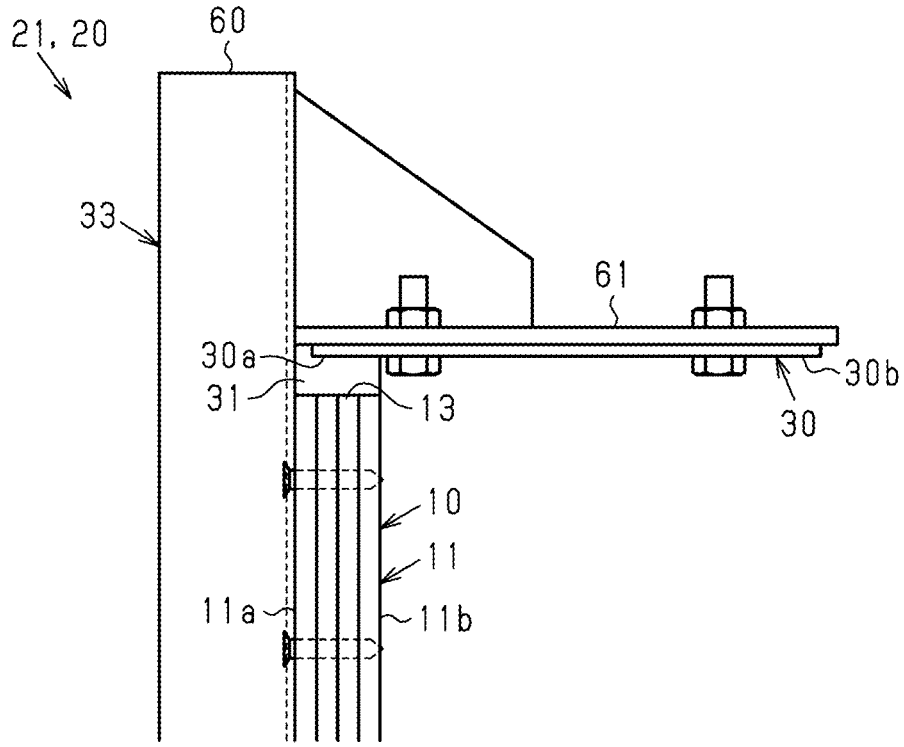
FIG. 17 is a side view of the first anchor support fixed to the formwork.

As shown in FIG. 17, the first anchor support 21 includes the support plate 30, a spacer 31, and a fixing jig 33. The support plate 30 includes support portions 34. Each support portion 34 supports the anchors 7. The support plate 30 is formed using a steel plate.

Figure 10:
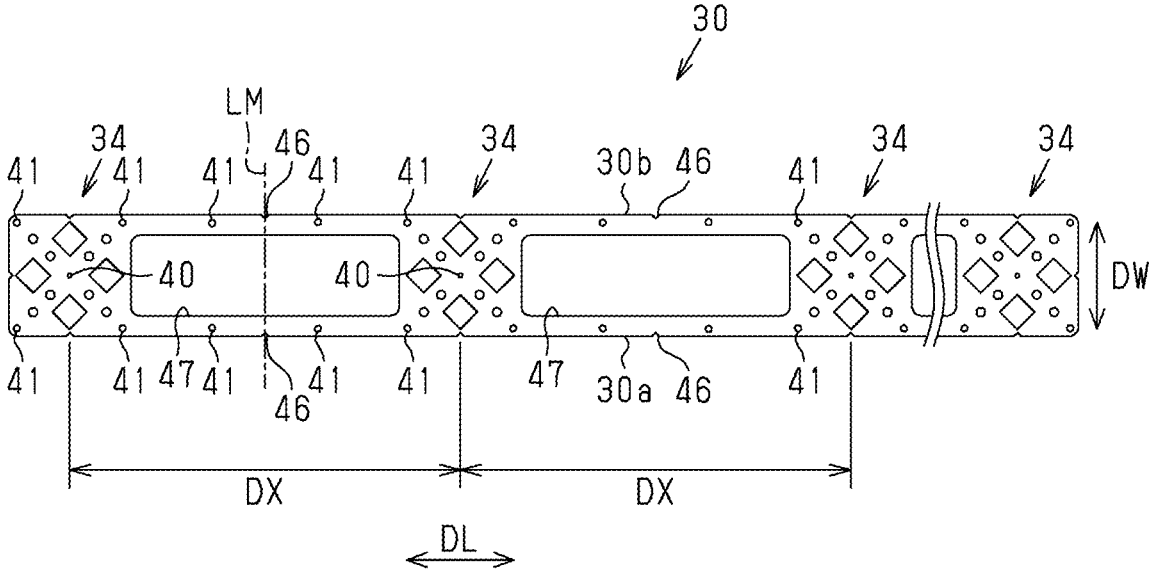
FIG. 10 is a plan view of a support plate.

As shown in FIG. 10, the support plate 30 includes a reference position 40 of each support portion 34. The reference position 40 is a reference center point of the support portion 34. The support plate 30 includes screw holes 41. The screw holes 41 are arranged at the opposite ends of the support plate 30 in a width direction DW, which is orthogonal to a longitudinal direction DL of the support plate 30. The screw holes 41 are arranged at equal intervals along the edges of the support plate 30 at the opposite ends of the support plate 30 in the width direction DW. The screw holes 41 are arranged with reference to the reference position 40. The screw holes 41 are arranged at the opposite ends of the support plate 30 in the width direction DW at the same pitch.

The support plate 30 is temporarily fixed to the formwork 10 with screws. The screws are driven into the formwork 10 through the screw holes 41 of the support plate 30, with the spacer 31 located in between. In the temporarily fixed state, the support plate 30 is fixed to the formwork 10 before the support plate 30 is fixed by the fixing jig 33. In the temporarily fixed support plate 30, a first end 30*a* on one side in the width direction DW is fixed to the formwork 10 with the screws. A second end 30*b* of the support plate 30 on the other side in the width direction DW is a free end (refer to FIG. 17).

Figure 11:
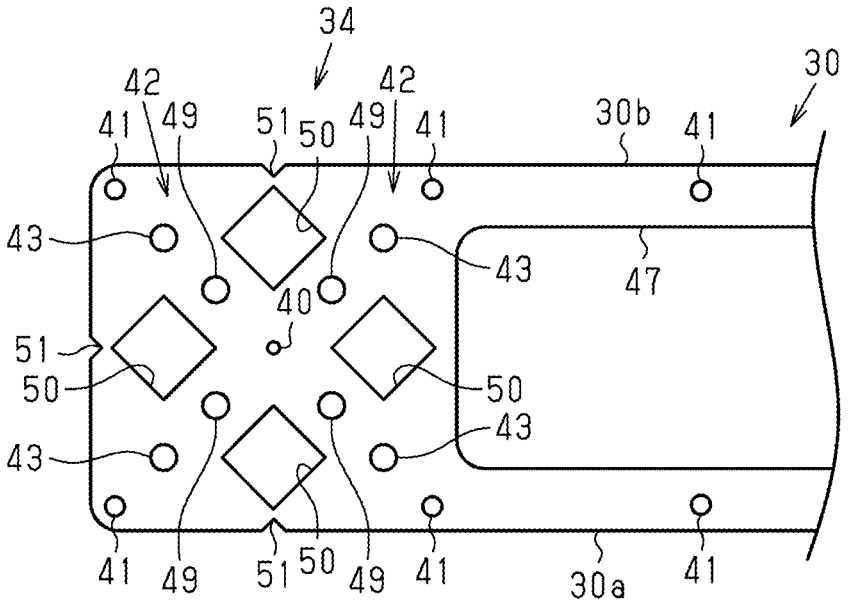
FIG. 11 is an enlarged view of the support plate.

As shown in FIG. 11, the support plate 30 includes fastening portions 42 to which an arm 61 of the fixing jig 33 is fastened. Each fastening portion 42 includes fastening holes 43 through which bolts are respectively inserted. In the present embodiment, the support plate 30 includes four fastening holes 43. Two of the fastening holes 43 are located relatively near the first end 30*a* of the support plate 30 on one side in the width direction DW. The other two fastening holes 43 are located relatively near the second end 30*b* of the support plate 30 on the other side in the width direction DW.

As shown in FIG. 10, the support plate 30 may include first positioning marks 46. Each first positioning mark 46 is used to position an additional support plate 45. The first positioning mark 46 is configured to indicate an intermediate position of two support portions 34. For example, the first positioning mark 46 is arranged at the intersection of a median LM, which is equidistant from the reference positions 40 of the two support portions 34, and an edge of the support plate 30 in the width direction DW.

The support plate 30 may include openings 47. The openings 47 are arranged to reduce the weight of the support plate 30. Each opening 47 is located between two support portions 34 of the support plate 30. For example, the opening 47 is configured to include an intermediate portion of the two support portions 34. This allows the anchors 7 to be inserted through the additional support plate 45 when the additional support plate 45 is arranged at the intermediate portion of the two support portions 34 of the support plate 30.

The support plate 30 has a predetermined length. For example, the support plate 30 has a length that is greater than or equal to two feet. The first anchor support 21 may include various types of support plates 30, each having a different length. The various support plates 30 each include multiple support portions 34. In the various support plates 30, the distance between the support portions 34 is set to the same predetermined distance DX. The predetermined distance DX is, for example, two feet.

Figure 12:
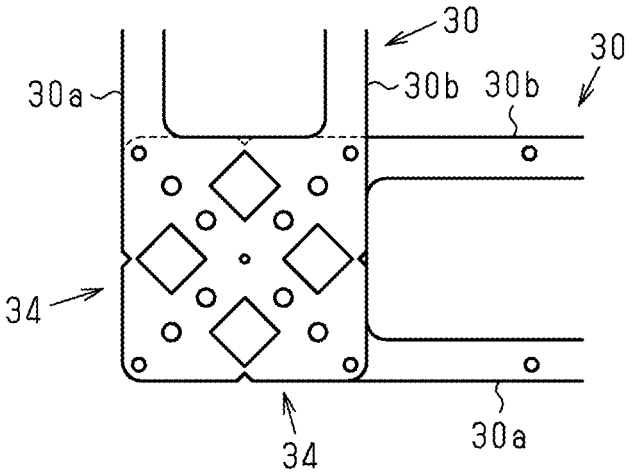
FIG. 12 is a diagram showing an example of a combination of support plates.

As shown in FIG. 12, in the formwork 10, various types of support plates 30 or the same type of support plates 30 are arranged such that their support portions 34 overlap each other. Thus, the distance between the support portions 34 is set to the same predetermined distance DX across the support plates 30 that are continuously arranged.

As shown in FIG. 11, the support portion 34 includes at least one anchor hole 49 through which the anchor 7 is inserted. In the support portion 34, the anchor hole 49 is located at a predetermined position relative to the reference position 40 of the support portion 34. For example, the support portion 34 includes four anchor holes 49. The four anchor holes 49 are respectively located at positions of the vertices of a square that has the reference position 40 as its center point.

The support portion 34 includes viewing holes 50. Each viewing hole 50 is configured to allow the anchor 7 to be seen with the anchor 7 inserted through a corresponding anchor hole 49. The viewing hole 50 is located relatively near the anchor hole 49.

The support portion 34 includes marks 51 that are used to position the support portion 34 relative to the reference of the foundation 1. Each mark 51 is arranged with reference to the reference position 40 of the support portion 34. For example, the mark 51 is formed as a cutout in the edge of the support plate 30. The mark 51 may be formed on the support plate 30 as a groove, a recess, or a projection.

The reference of the foundation 1 is set using a reference string (leveling string) configured to be stretched on the foundation ground 2. During arrangement of the first anchor support 21, the position of the support plate 30 is adjusted such that the marks 51 of the support portion 34 of the support plate 30 extend along the reference string. After the support plate 30 is arranged at a predetermined position, the support plate 30 is temporarily fixed to the formwork 10 using screws.

The same support portions 34 are used for various types of anchor supports 20. Specifically, the support portions 34 of the first anchor support 21, the second anchor support 22, and the third anchor support 23 have the same structure.

Figure 13:
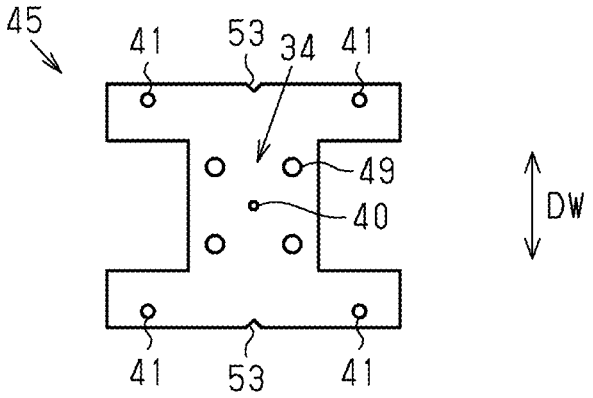
FIG. 13 is a plan view of an additional support plate.

Referring to FIG. 13, the first anchor support 21 may include the additional support plate 45. The additional support plate 45 is used to add the support portion 34 to the support plate 30. The additional support plate 45 includes a support portion 34 that has the same structure as the support portion 34 of the support plate 30. Specifically, the additional support plate 45 includes the support portion 34 having the same structure as the support portion 34 of the support plate 30 regarding the positional relationship between the reference position 40 and the anchor holes 49.

The additional support plate 45 includes screw holes 41. The pitch of each screw hole 41 is equal to the pitch of the screw hole 41 of the support plate 30. The screw holes 41 are arranged with reference to the reference position 40 of the support portion 34. The additional support plate 45 includes second positioning marks 53. Each second positioning mark 53 is arranged at the intersection of a line that extends through the reference positions 40 of the support portion 34 in the width direction DW and an edge of the support plate 30 in the width direction DW.

Figure 14:
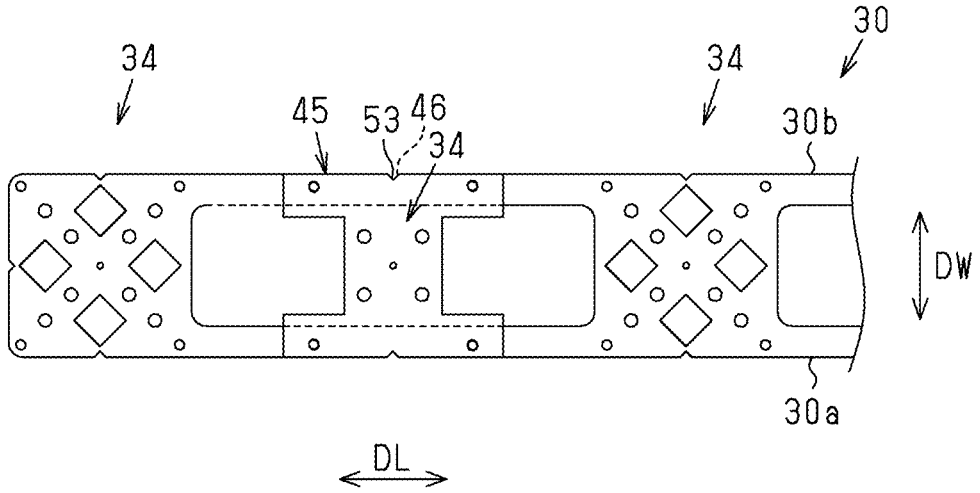
FIG. 14 is a plan view of the support plate to which the additional support plate is attached.

As shown in FIG. 14, when the additional support plate 45 is arranged on the support plate 30, the additional support plate 45 is positioned relative to the support plate 30 such that the second positioning marks 53 of the additional support plate 45 are respectively aligned with the first positioning marks 46 of the support plate 30. After the additional support plate 45 is positioned relative to the support plate 30, the additional support plate 45 is fixed to the formwork 10 using screws. In this manner, an additional support portion 34 can be arranged at the intermediate position between two support portions 34 of the support plate 30.

Figure 15:
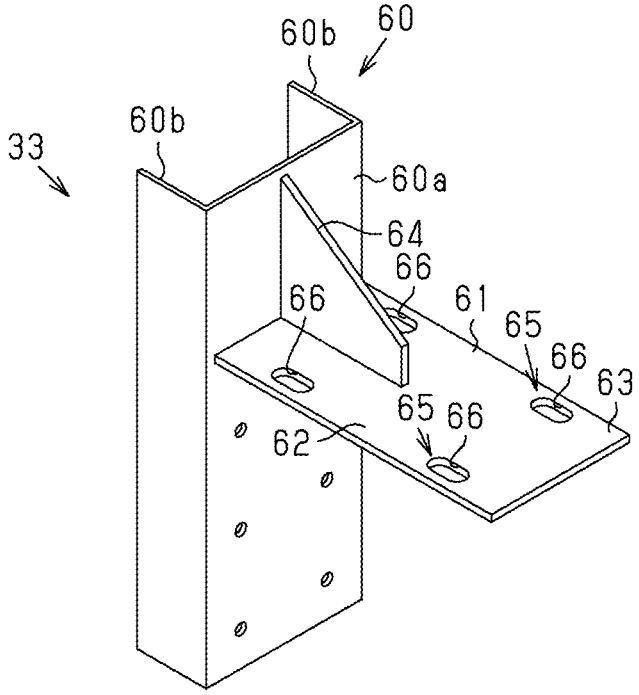
FIG. 15 is a perspective view of the fixing jig.

The fixing jig 33 will now be described with reference to FIG. 15. The fixing jig 33 fixes the support plate 30 to the formwork 10. The fixing jig 33 supports the support plate 30 that is arranged on the formwork 10, with the spacer 31 located between the support plate 30 and the formwork 10 (see FIG. 17).

The fixing jig 33 includes a body 60 and the arm 61. The body 60 and the arm 61 are made of iron. The body 60 and the arm 61 may be made of aluminum alloy. The arm 61 is fixed to the body 60 through welding or fastening.

The body 60 is arranged along an outer surface 11*a* of the formwork 10 and fixed to the formwork 10 (see FIG. 17). The body 60 includes a plate 60*a* that is in contact with the outer surface 11*a* of the formwork 10 and reinforcement portions 60*b* that reinforce the plate 60*a*. The plate 60*a* extends in its vertical direction with the fixing jig 33 fixed to the formwork 10. The reinforcement portions 60*b* are arranged at the opposite ends of the plate 60*a* in its width direction, which intersects the vertical direction. The reinforcement portions 60*b* project in a direction opposite to the direction in which the arm 61 projects. The reinforcement portions 60*b* extend in the vertical direction along the edge of the plate 60*a*. The plate 60*a* is formed integrally with the reinforcement portions 60*b*.

The arm 61 supports the support plate 30. The arm 61 extends from the body 60. The arm 61 extends from the body 60 in a direction orthogonal to the vertical direction. The arm 61 includes a base portion 62 configured to be connected to the body 60 and a distal end 63 that is located on a side opposite to the base portion 62. The arm 61 has the form of a plate. The arm 61 may be supported by the reinforcing support portion 64. The reinforcing support portion 64 connects the upper surface of the base portion 62 of the arm 61 to the upper part of the body 60. The upper part of the body 60 refers to a part of the body 60 that is above the part to which the arm 61 is connected.

The arm 61 includes fastening portions 65 to which the support plate 30 is fastened. Each fastening portion 65 includes a fastening hole 66 through which a bolt is inserted. In the present embodiment, the arm 61 includes four fastening holes 66. Two of the fastening holes 66 are arranged relatively near the base portion 62 of the arm 61. The other two fastening holes 66 are located relatively near the distal end 63 of the arm 61.

Figure 18:
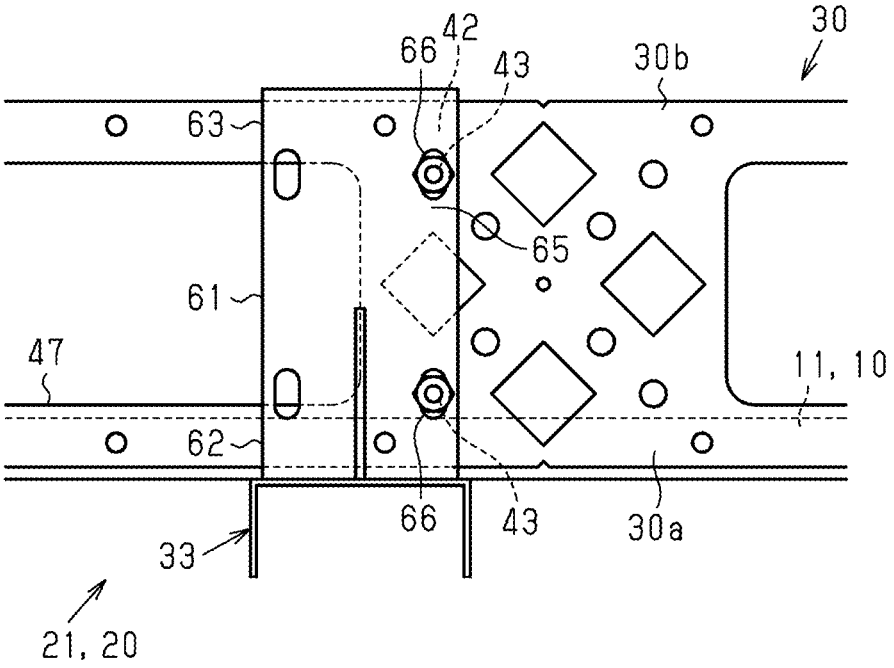
FIG. 18 is a plan view of the first anchor support fixed to the formwork.

As shown in FIG. 18, the arm 61 is arranged in the width direction DW of the support plate 30. The base portion 62 of the arm 61 supports the first end 30*a* of the support plate 30 on one side in the width direction DW. The distal end 63 of the arm 61 supports the second end 30*b* of the support plate 30 on the other side in the width direction DW. The structure in which the base portion 62 of the arm 61 supports the first end 30*a* of the support plate 30 may be omitted.

As shown in FIG. 17, the spacer 31 is located between the end of the support plate 30 and the upper end surface 13 of the formwork 10. The spacer 31 positions the support plate 30 in a height direction relative to the formwork 10 of the foundation 1. The spacer 31 has a predetermined thickness. The spacer 31 is sized so as to be arranged on the formwork 10. For example, the width of the spacer 31 is equal to the width of the formwork 10. For example, the spacer 31 has the form of a rectangular prism or a cube. The spacer 31 is a member into which a screw can be driven. For example, the spacer 31 is made of wood or resin. As shown in a modification that will be described later, the spacer 31 may be made of sheet metal.

In the temporarily fixed state of the support plate 30, the spacer 31 is spaced apart from the upper end surface 13 of the formwork 10. The spacer 31 may be fixed to the formwork 10 using adhesive. The support plate 30 is arranged such that the first end 30*a* of the support plate 30 on one side in the width direction DW is placed on multiple spacers 31. In this manner, the support plate 30 is positioned relative to the upper end surface 13 of the formwork 10 in the height direction.

The anchors 7 are arranged in the method for constructing the foundation 1 in the following manner. The spacer 31 is arranged on the upper end surfaces 13 of the formwork 10. The support plate 30 is arranged such that the first end 30*a* of the support plate 30 is placed on the spacers 31. Further, the support plate 30 is temporarily fixed to the formwork 10 with screws.

Figure 16:
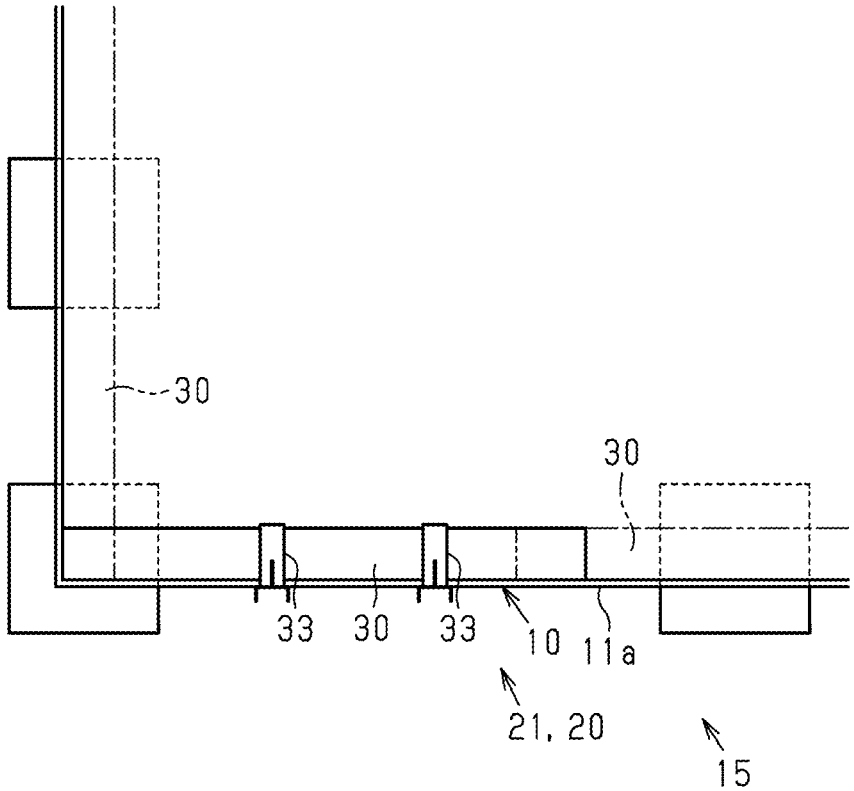
FIG. 16 is a diagram showing the arrangement of the formwork and the first anchor support.

As shown in FIG. 16, the support plates 30 are arranged along the inner surface of the formwork 10. Adjacent ones of the support plates 30 are arranged such that their support portions 34 overlap each other. After the support plates 30 are arranged, each support plate 30 is fixed to the formwork 10 using the fixing jig 33 with the first end 30*a* of the support plate 30 on one side in the width direction DW placed on the spacer 31. Specifically, the body 60 is fixed to the formwork 10 with the body 60 of the fixing jig 33 in contact with the outer surface 11*a* of the formwork 10 and the arm 61 in contact with the upper surface of the support plate 30. Further, the arm 61 and the support plate 30 are fastened to each other using bolts. The support plate 30 of the first anchor support 21 is located at a predetermined height from the upper end surface 13 of the formwork 10. The anchors 7 are attached to the support plate 30 that has been fixed in this manner.

Second Anchor Support

The second anchor support 22 will now be described with reference to FIGS. 19 and 20. The second anchor support 22 supports the anchors 7 arranged on the foundation 1. The second anchor support 22 includes the support portion 34, a fixed portion 70 configured to be fixed to the formwork 10, and a coupling portion 71 that couples the support portion 34 to the fixed portion 70. The coupling portion 71 couples the support portion 34 to the fixed portion 70 such that the support portion 34 is located at a position from the fixed portion 70 by a predetermined height with the fixed portion 70 arranged horizontally. The distance between the lower surface of the support portion 34 and the lower surface of the fixed portion 70 is equal to the thickness of the spacer 31 of the first anchor support 21.

The fixed portion 70 of the second anchor support 22 is fixed to the upper end surface 13 of the formwork 10. The second anchor support 22 is used to arrange the anchors 7 at positions of the formwork 10 where the first anchor support 21 cannot be installed.

The second anchor support 22 has two types of forms depending on the position where the second anchor support 22 is installed. Specifically, the second anchor support 22 includes a fourth anchor support 24 and a fifth anchor support 25. The fifth anchor support 25 is formed by coupling two fourth anchor supports 24 to each other.

Figure 19:
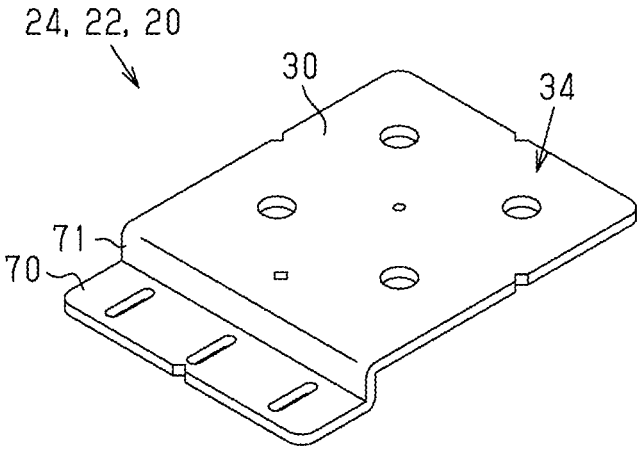
FIG. 19 is a perspective view of a fourth anchor support, which is an example of the second anchor support.

As shown in FIG. 19, the fourth anchor support 24 includes a support plate 30 having one support portion 34, the fixed portion 70, which is configured to be fixed to the formwork 10, and the coupling portion 71, which couples the support portion 34 to the fixed portion 70.

Figure 21:
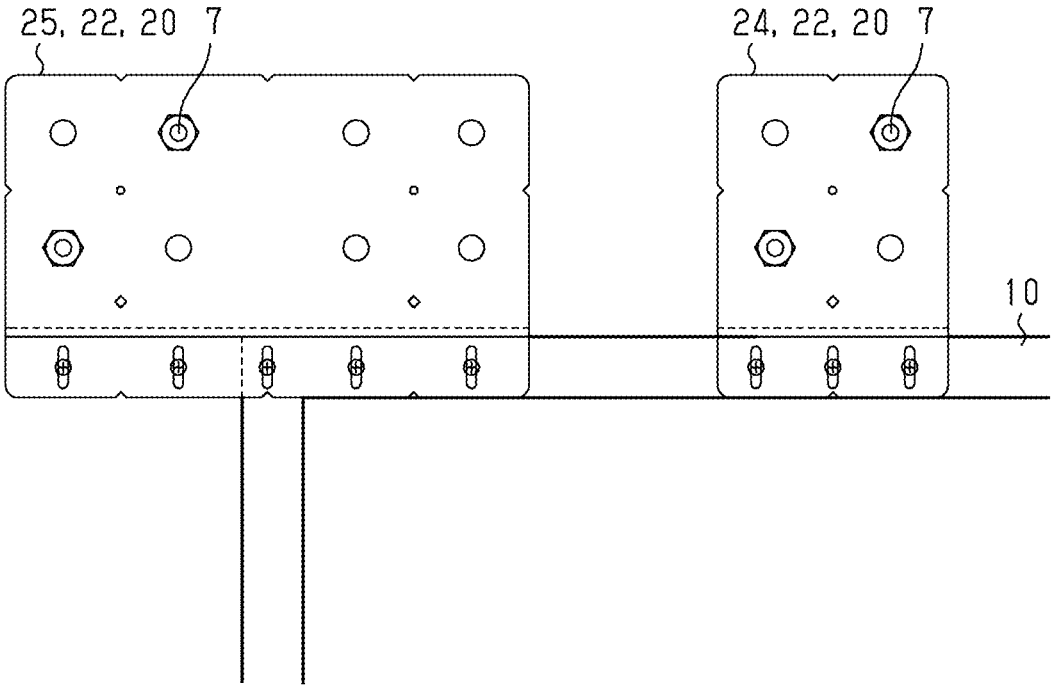
FIG. 21 is a diagram showing the arrangement of the fourth anchor support and the fifth anchor support.

As shown in FIG. 21, the fourth anchor support 24 is arranged at a portion of the formwork 10 where the straight-line distance is shorter than two feet. Two or more fourth anchor supports 24 may be continuously arranged.

Figure 20:
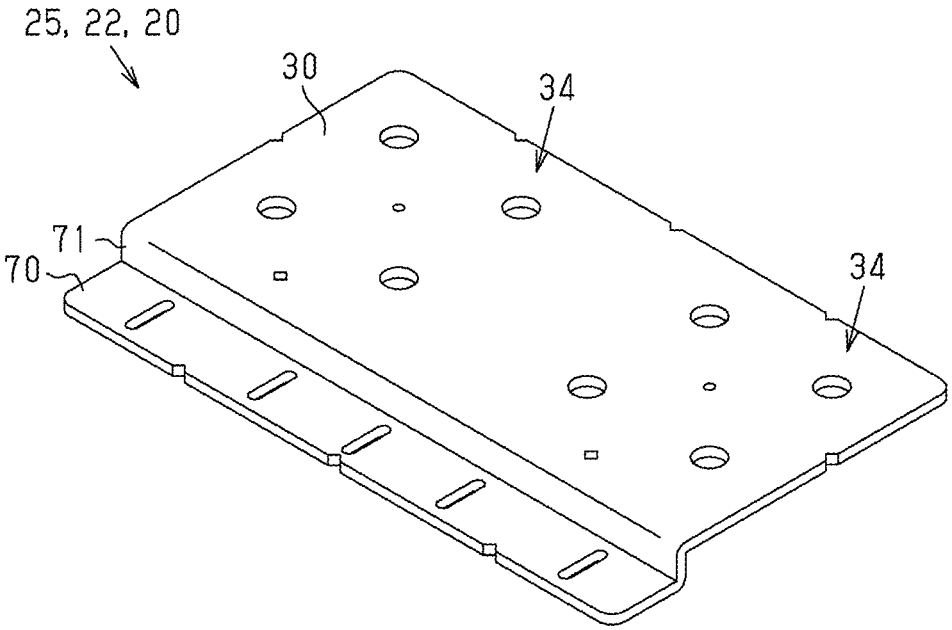
FIG. 20 is a perspective view of a fifth anchor support, which is another example of the second anchor support.

As shown in FIG. 20, the fifth anchor support 25 includes a support plate 30 having two support portions 34, the fixed portion 70, which is configured to be fixed to the formwork 10, and the coupling portion 71, which couples the support portion 34 to the fixed portion 70.

As shown in FIG. 21, the fifth anchor support 25 is installed at an outside corner of the formwork 10. The fifth anchor support 25 is fixed to the formwork 10 such that one of the two support portions 34 is located at a diagonal position corresponding to the outside corner.

In the arrangement of the anchors 7 in the method for constructing the foundation 1, the fourth anchor support 24 and the fifth anchor support 25 are used as follows. In the fourth step, the fixed portion 70 of the fourth anchor support 24 is fixed to the upper end surface 13 of the formwork 10. This causes the support plate 30 of the fourth anchor support 24 to be fixed at the predetermined height from the upper end surface 13 of the formwork 10. The anchors 7 are attached to the support plate 30.

Half of the fixed portion 70 of the fifth anchor support 25 is arranged at the outside corner of the formwork 10 to fix the fixed portion 70 to the upper end surface 13 of the formwork 10. As a result, the support plate 30 of the fifth anchor support 25 is fixed at the predetermined height from the upper end surface 13 of the formwork 10, with one of the two support portions 34 located at a diagonal position corresponding to the outside corner. The anchors 7 are attached to the support plate 30.

Third Anchor Support

The third anchor support 23 supports the anchors 7 arranged in the foundation hole 1*a*. The third anchor support 23 includes the support plate 30 having one or more support portions 34, the reference anchors 9, and spacers 75. The reference anchors 9 are arranged around the foundation hole 1*a* of the foundation 1, which includes the foundation hole 1*a*. The reference anchors 9 are each arranged at a predetermined position with respect to the foundation hole 1*a*. The spacers 75 are arranged around the foundation hole 1*a* of the foundation 1 (refer to FIG. 8). Each spacer 75 may have a hole through which a corresponding reference anchor 9 is inserted. The thickness of the spacer 75 of the third anchor support 23 is equal to the thickness of the spacer 31 of the first anchor support 21. The support plate 30 is mounted on the spacers 75 and engaged with the reference anchors 9.

In the arrangement of the anchors 7 in the method for constructing the foundation 1, the third anchor support 23 is used as follows. In the sixth step, the reference anchors 9 are each driven into the surrounding portion of the foundation hole 1*a* at a predetermined position. The spacers 75 are arranged on the foundation 1 to be respectively engaged with the reference anchors 9. The support plate 30 is arranged with reference to the reference anchors 9. Specifically, the support plate 30 is arranged on the foundation 1 such that the reference anchors 9 are respectively inserted through other anchor holes 49 of the support plate 30. The other anchor holes 49 are anchor holes 49 excluding the anchor holes 49 that are respectively used to support the anchors 7 arranged in the foundation hole 1*a*. The support plate 30 is placed on the spacers 75. As a result, the support plate 30 is located at a predetermined height from the upper surface of the foundation 1 (refer to FIG. 8). The anchors 7 are attached to the support plate 30 that has been arranged in this manner. The anchors 7 attached to the support plate 30 are each located at the predetermined position with respect to the foundation hole 1*a*.

The operation of the present embodiment will now be described.

The support plate 30 is located at a predetermined height from the upper end surface 13 of the formwork 10. This creates the space between the support plate 30 and the upper surface of the foundation 1. The support plate 30 is located at a position separated from the upper surface of the concrete 8. Thus, in the task of leveling the concrete 8, the lower part of the support plate 30 is leveled by a trowel such that the height of the upper surface of the concrete 8 coincides with the height of the upper end surface 13 of the formwork 10. This allows the upper surface of a portion relatively near the anchors 7 to be flat and accurately formed on a surface at a predetermined height.

The support plate 30 is supported by the first anchor support 21, which includes the arm 61. Thus, bending of the support plate 30 is limited. This limits situations in which the anchors 7, which are supported by the support plate 30, are each displaced from a predetermined position.

The advantages of the first anchor support 21 and the formwork set 15 of the present embodiment will now be described.

(1) The anchor support 20 includes the support plate 30, the spacer 31, which positions the support plate 30 in the height direction relative to the formwork 10 of the foundation 1, and the fixing jig 33, which fixes the support plate 30 to the formwork 10. The fixing jig 33 supports the support plate 30, with the support plate 30 arranged on the formwork 10 using the spacer 31.

If the support plate 30 is fixed to the formwork 10 only using a screw and the anchors 7 are attached to the support plate 30, the weights of the anchors 7 may cause the support plate 30 to flex. This lowers the position accuracy of the anchors 7. In this respect, the support plate 30 is supported by the fixing jig 33 and fixed to the formwork 10. When the anchors 7 are attached to the support plate 30, the load on the anchors 7 is applied to the fixing jig 33. This limits flexing of the support plate 30. As a result, the position accuracy of the anchors 7 is improved in the foundation 1.

(2) The fixing jig 33 includes the body 60, which is configured to be arranged along the outer surface 11*a* of the formwork 10 and fixed to the formwork 10, and the arm 61, which extends from the body 60 to support the support plate 30.

In this configuration, the support plate 30 is supported by the arm 61 extending from the body 60, which is configured to be fixed to the formwork 10. The arm 61 supports a portion of the support plate 30 that is separated from the formwork 10. This limits flexing of the support plate 30 in the direction that is orthogonal to an inner surface 11*b* of the formwork 10. This improves the position accuracy of the anchors 7.

The support plate 30 may be supported by multiple fixing jigs 33. For example, the fixing jigs 33 are spaced apart from each other in the longitudinal direction DL of the support plate 30 (see FIG. 16). Since the support plate 30 is supported by the fixing jigs 33, flexing of the support plate 30 in the longitudinal direction DL is limited. Further, the support plate 30 is supported by the arms 61 of the fixing jigs 33. This limits the flexing of the support plate 30 in the width direction DW even when the anchors 7 are attached to the support plate 30.

(3) The arm 61 of the fixing jig 33 includes the fastening portion 65, to which the support plate 30 is fastened. In this configuration, the support plate 30 is firmly fixed to the arm 61. This limits situations in which the support plate 30 is detached from the arm 61 by shaking of the foundation ground 2.

(4) Each support portion 34 of the support plate 30 includes at least one anchor hole 49, through which the anchor 7 is inserted. In the support portion 34, the anchor hole 49 is located at a predetermined position relative to the reference position 40 of the support portion 34. In this configuration, each anchor 7 is located at a predetermined position on the support plate 30. Thus, the anchor 7 is arranged at a predetermined position with respect to the foundation ground 2 simply by arranging the support plate 30 at a predetermined position relative to the foundation ground 2 and inserting the anchor 7 into the anchor hole 49.

(5) The support plate 30 includes multiple support portions 34. In the support plate 30, the support portions 34 are spaced apart from each other by the predetermined distance DX. This configuration allows multiple anchors 7 to be each located at a predetermined position relative to the foundation ground 2 using a single support plate 30.

The first anchor support 21 may include various types of support plates 30, each having a different length. This allows for a greater variation in locations where the first anchor support 21 can be installed. In each type of the support plates 30, the distance between the support portions 34 is set to the same predetermined distance DX.

Each type of the support plates 30 includes the support portion 34 having the same structure. In this configuration, when different types of support plates 30 are combined or when the same type of support plates 30 are combined, the support portions 34 of adjacent two support plates 30 are overlapped with each other so that the distance between the support portions 34 is set to the same predetermined distance DX across the support plates 30 that are continuously arranged. In this manner, each anchor 7 is arranged at a predetermined pitch. The support plate 30 has a function similar to a ruler, allowing for the placement of the anchor 7 at a predetermined pitch. The use of such a support plate 30 allows each anchor 7 to be readily arranged at a predetermined position.

(6) The anchor support 20 may include the additional support plate 45. The additional support plate 45 includes the support portion 34, which has the same structure as the support portion 34 of the support plate 30. This configuration allows the number of the anchors 7 supported by a single support plate 30 to be increased as necessary.

(7) In the first anchor support 21, the support portion 34 may include the mark 51, which is used to position the support portion 34 relative to the reference of the foundation 1. In this configuration, the mark 51 is aligned with the reference of the foundation 1 so that the support portion 34 is accurately located relative to the reference of the foundation 1.

(8) The formwork set 15 includes the anchor support 20. The formwork set 15 includes the anchor support 20 and thus limits flexing of the support plate 30. As a result, the position accuracy of the anchors 7 is improved in the foundation 1.

The advantages of the second anchor support 22 of the present embodiment will now be described.

(1) The second anchor support 22 includes the support portion 34, which supports the anchors 7, the fixed portion 70, which is configured to be fixed to the formwork 10 of the foundation 1, and the coupling portion 71. The coupling portion 71 couples the support portion 34 to the fixed portion 70 such that the support portion 34 is located at a predetermined height from the fixed portion 70 with the fixed portion 70 arranged horizontally.

In this configuration, when the fixed portion 70 is fixed to the formwork 10 of the foundation 1, the support portion 34 is located at a higher position than the upper end surface 13 of the formwork 10. This allows the concrete 8 to be leveled such that the upper surface of the concrete 8 is located at the same height as the upper end surface 13 of the formwork 10. The upper surface of the concrete 8 does not include a portion concealed by the formwork 10. This allows the entire upper surface of the concrete 8 to be seen and thus facilitates the task of leveling the concrete 8. Accordingly, the upper surface of the foundation 1 is readily formed to be flat at a predetermined height.

(2) In the second anchor support 22, the support portion 34 includes the mark 51, which is used to position the support portion 34 relative to the reference of the foundation 1. In this configuration, the mark 51 is aligned with the reference of the foundation 1 so that the support portion 34 is accurately located relative to the reference of the foundation 1.

The advantage of the third anchor support 23 of the present embodiment will now be described.

The third anchor support 23 includes the support plate 30, which includes the support portion 34, and the spacers 75. The spacers 75 are arranged around the foundation hole 1*a* of the foundation 1. The support plate 30 is placed on the spacers 75 to extend across the foundation hole 1*a*. Further, the support plate 30 is positioned by the reference anchors 9 or other anchors 7. The other anchors 7 are the anchors 7 of the foundation 1 including the foundation hole 1*a*. This configuration allows the support plate 30 of the third anchor support 23 to be positioned at a predetermined height from the upper surface of the surrounding portion of the foundation hole 1*a*. Accordingly, the concrete 8 is leveled such that the upper surface of the concrete 8, with which the foundation hole 1*a* is filled, is located at the same height as the upper surface of the surrounding portion of the foundation hole 1*a*.

The advantages of the method for constructing the foundation 1 of the building according to the present embodiment will now be described.

(1) In the method for constructing the foundation 1 of the building, when the concrete 8 is placed, the concrete 8 is leveled such that the upper surface of the concrete 8 is located at the same height as the upper end surface 13 of the formwork 10.

This configuration allows the concrete 8 to be leveled with reference to the upper end surface of the formwork 10. Thus, the task of leveling the concrete 8 is facilitated. Accordingly, the upper surface of the foundation 1 is readily formed to be flat at a predetermined height.

(2) In the method for constructing the foundation 1 of the building, the anchor support 20 is fixed to the formwork 10 such that the support portion 34 of the anchor support 20 is located at a position higher than the upper end surface 13 of the formwork 10. The anchor support 20 fixed in this manner are used to support the anchors 7.

In this configuration, the support portion 34 is located at a higher position than the upper end surface 13 of the formwork 10. This allows the concrete 8 to be leveled such that the upper surface of the concrete 8 is located at the same height as the upper end surface 13 of the formwork 10.

(3) In the method for constructing the foundation 1 of the building, the spacer 31 is arranged on the upper end surface 13 of the formwork 10, and the support plate 30 is fixed to the formwork 10 using the fixing jig 33 with the end of the support plate 30 placed on the spacer 31. In this configuration, the support plate 30 is fixed to the formwork 10 using the spacers 31. This allows the support plate 30 to be readily arranged at a predetermined height from the upper end surface 13 of the formwork 10.

(4) In the method for constructing the foundation 1 of the building, the fixed portion 70 of the second anchor support 22 is fixed to the upper end surface 13 of the formwork 10. This configuration allows the support portion 34 to be readily located at the predetermined height from the upper end surface 13 of the formwork 10 without using the spacer 31.

(5) In the method for constructing the foundation 1 of the building, the concrete 8 is placed in the foundation hole 1*a*, and the concrete 8 is leveled such that the upper surface of the concrete 8 is located at the same height as the upper surface of the surrounding portion of the foundation hole 1*a*.

In this configuration, it is difficult to level the concrete 8 such that the upper surface of the concrete 8 placed in the foundation hole 1*a* is located at a lower predetermined height than the upper surface of the surrounding portion of the foundation hole 1*a*. In the above configuration, the concrete 8 is leveled such that the upper surface of the concrete 8 is located at the same height as the upper surface of the surrounding portion of the foundation hole 1*a*. This facilitates the task of leveling the concrete 8.

(6) In the method for constructing the foundation 1 of the building, the support plate 30 is arranged such that the support plate 30 is located at a higher position than the upper surface of the foundation 1 when the anchors 7 are each located at a predetermined position in the foundation hole 1*a*. In this configuration, the support plate 30 is located at a higher position than the upper surface of the foundation 1. This facilitates the task of leveling the concrete 8 such that the upper surface of the concrete 8 placed in the foundation hole 1*a* is located at the same height as the upper surface of the surrounding portion of the foundation hole 1*a*.

(7) In the method for constructing the foundation 1 of the building, when the anchors 7 are each located at a predetermined position in the foundation hole 1*a*, the reference anchors 9 are each driven into the surrounding portion of the foundation hole 1*a* at a predetermined position. Further, the support plate 30 is arranged with reference to the reference anchor 9. In this configuration, the support plate 30 is located at a predetermined position relative to the foundation hole 1*a*. This allows the anchors 7 supported by the support plate 30 to be accurately located relative to the foundation hole 1*a*.

(8) In the method for constructing the foundation 1 of the building, the support plate 30 may be arranged with reference to the anchors 7 arranged along the inner surface of the outer frame 11 (see the long dashed double-short dashed line in FIG. 8). In this configuration, the support plate 30 is located at a predetermined position with respect to the anchors 7 located along the outer frame 11. This allows the anchors 7 supported by the support plate 30 to be accurately located relative to the anchors 7 located along the outer frame 11.

Modifications

The above embodiment exemplifies, without any intention to limit, applicable forms of the anchor support 20, the formwork set 15, and the method for constructing the foundation 1. The anchor support 20, the formwork set 15, and the method for constructing the foundation 1 may each take a form different from that illustrated in the embodiment. For example, some of the components of the embodiment may be replaced, changed, or omitted. Alternatively, new components may be added to the embodiment. Modifications of the embodiment will now be described. In the modifications, the same reference characters are given to those components that are the same as the corresponding components of the above embodiment. Such components will not be described.

Figure 22:
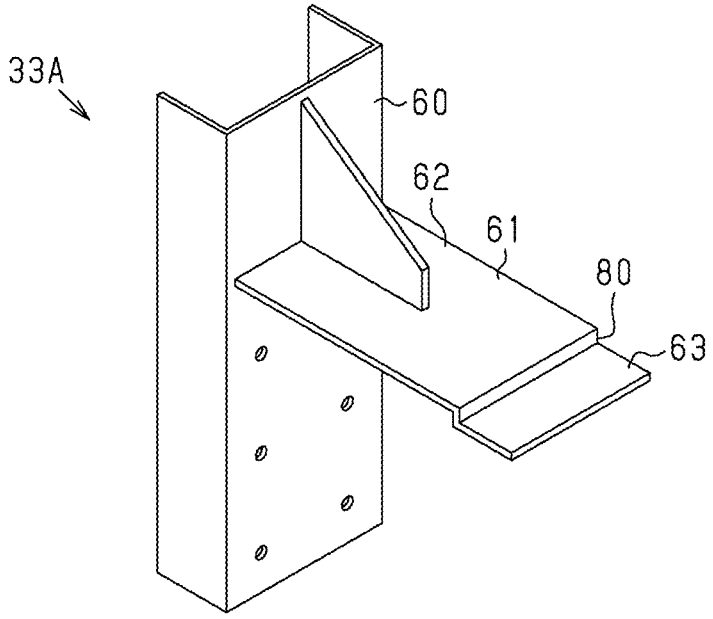
FIG. 22 is a perspective view showing the fixing jig according to a first modification.
Figure 23:
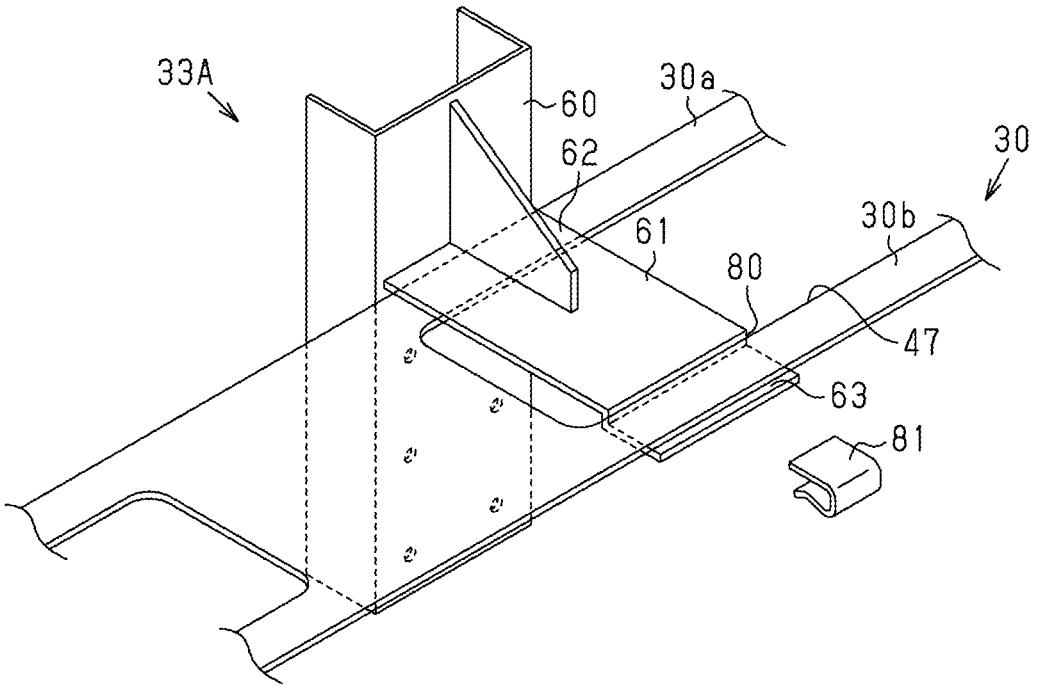
FIG. 23 is a diagram showing the relationship between the fixing jig of the first modification and the support plate.

A first modification of the fixing jig 33 will now be described with reference to FIGS. 22 and 23.

The joining structure between the arm 61 and the support plate 30 of a fixing jig 33A may be modified as follows. In the embodiment, the support plate 30 is fixed to the arm 61 by fastening the fastening portions 65 of the arm 61 and the fastening portions 42 of the support plate 30 to each other. In this modification, the distal end 63 of the arm 61 of the fixing jig 33A is configured to be engaged with the second end 30*b* of the support plate 30 on the side opposite to the first end 30*a*, which is configured to be fixed to the formwork 10.

The arm 61 is configured such that the distal end 63 is located at a lower position than the base portion 62. Specifically, the arm 61 includes a step 80 between the base portion 62 and the distal end 63. The step 80 is configured such that the distal end 63 is located at a lower position than the base portion 62. The step 80 is configured such that the distance between the lower surface of the base portion 62 of the arm 61 and the upper surface of the distal end 63 is equal to the thickness of the support plate 30. When the support plate 30 is attached to the arm 61, the base portion 62 of the arm 61 is arranged to contact the upper surface of the support plate 30, and the distal end 63 of the arm 61 is arranged to contact the lower surface of the support plate 30. The first end 30*a* of the support plate 30 on one side in the width direction DW is supported by the formwork 10. The second end 30*b* of the support plate 30 on the other side in the width direction DW is supported by the distal end 63 of the arm 61 from below. The second end 30*b* of the support plate 30 may be secured to the distal end 63 of the arm 61 using a clip 81 such that the second end 30*b* of the support plate 30 is not displaced from the distal end 63 of the arm 61.

Figure 24:
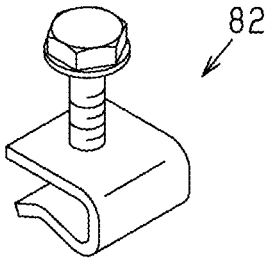
FIG. 24 is a perspective view of a clip according to another example.

The second end 30*b* of the support plate 30 may be secured to the distal end 63 of the arm 61 in any manner. Referring to FIG. 24, a bolted clip 82 may be used to secure the second end 30*b* of the support plate 30 to the distal end 63 of the arm 61. The second end 30*b* of the support plate 30 is firmly fixed to the distal end 63 of the arm 61 by tightening the bolt.

Figure 25:
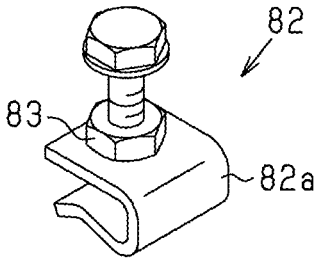
FIG. 25 is a perspective view of a clip according to a further example.

Referring to FIG. 25, the bolted clip 82 may have a threaded portion 83 that supports the bolt. The threaded portion 83 is joined to the clip body 82*a*. The threaded portion sustains the tightening force of the bolt.

Figure 26:
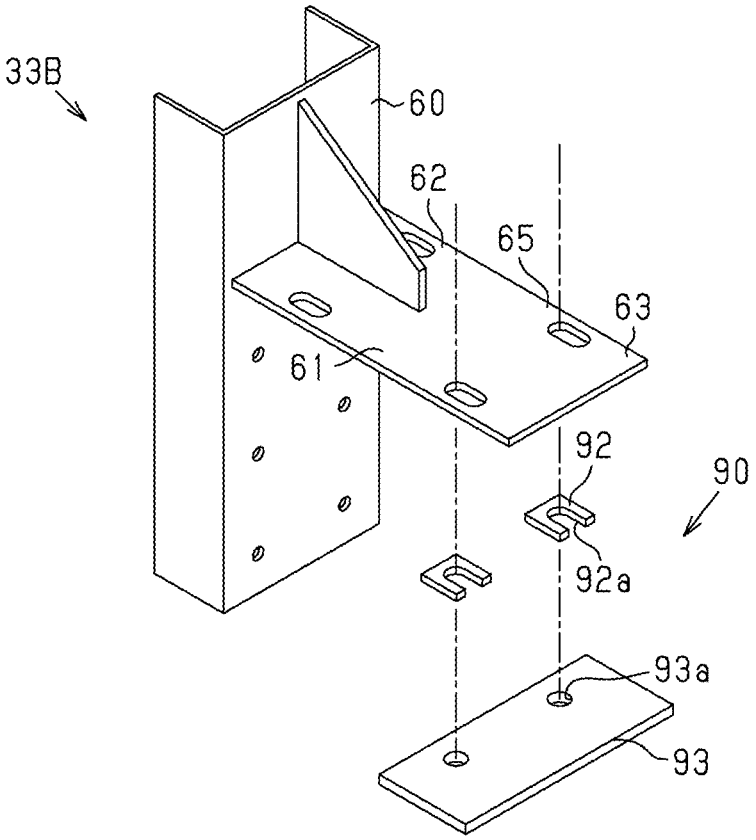
FIG. 26 is a perspective view of the fixing jig according to a second modification.
Figure 27:
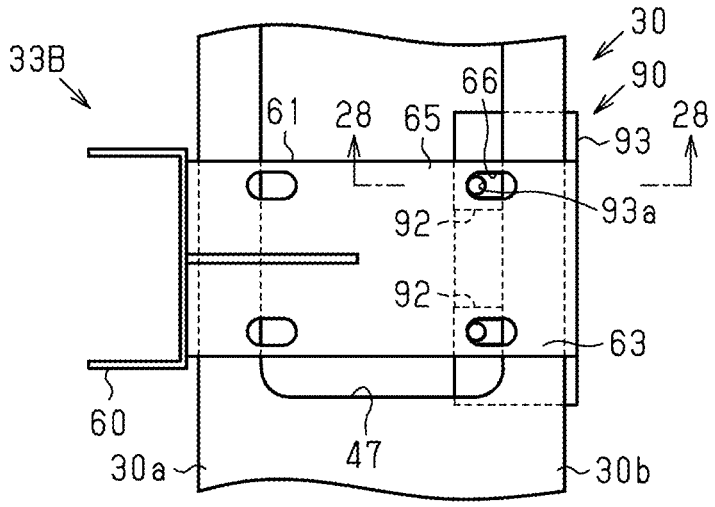
FIG. 27 is a plan view illustrating the relationship between the fixing jig of the second modification and the support plate.
Figure 28:
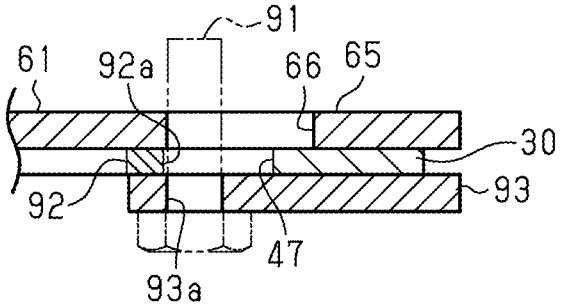
FIG. 28 is a cross-sectional view of the fixing jig taken along line 28-28 in FIG. 27.

A second modification of the fixing jig 33 will now be described with reference to FIGS. 26, 27, and 28. The joining structure between the arm 61 and the support plate 30 of a fixing jig 33B may be modified as follows. The structure of the arm 61 of the fixing jig 33B is not changed from that of the arm 61 of the embodiment. In the above embodiment, the support plate 30 is fixed to the arm 61 by fastening the fastening portions 65 of the arm 61 and the fastening portions 42 of the support plate 30 to each other.

In this modification, the fastening portions 65 of the arm 61 are fastened to portions of the support plate 30 other than the fastening portions 42. Specifically, an engagement member 90 is used to secure the distal end 63 of the arm 61 of the fixing jig 33B to the second end 30*b* of the support plate 30 on the side opposite to the first end 30*a*, which is configured to be fixed to the formwork 10.

The engagement member 90 includes bolts 91, spacers 92 configured to be arranged in the opening 47 of the support plate 30, and a plate 93 that has fastening holes 93*a*. Each spacer 92 includes a recess 92*a*. To fix the support plate 30 to the arm 61 of the fixing jig 33B, the arm 61 is arranged above the support plate 30 to overlap the opening 47 of the support plate 30. The plate 93 is arranged below the arm 61, with the support plate 30 located in between. The support plate 30 is held between the arm 61 and the plate 93. The thickness of each spacer 92 is equal to the thickness of the support plate 30. The spacer 92 is arranged at a portion of the opening 47 of the support plate 30 that is located between the arm 61 and the plate 93. The support plate 30 is fixed to the arm 61 by respectively inserting the bolts 91 through the fastening holes 66 of the arm 61, the fastening holes 93*a* of the plate 93, and the recesses 92*a* of the spacers 92 and fastening nuts configured to be engaged with the bolts 91 (refer to FIG. 28).

A third modification of the fixing jig 33 will now be described with reference to FIG. 29.

Figure 29:
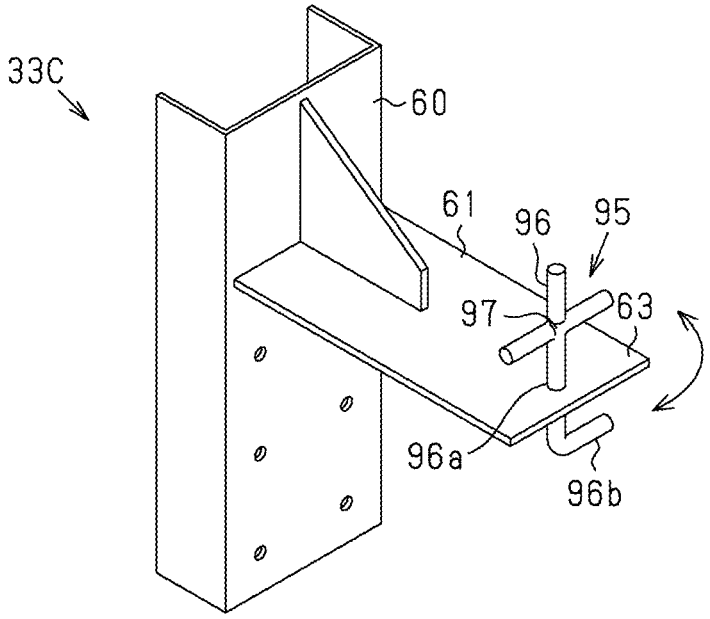
FIG. 29 is a perspective view showing the fixing jig according to a third modification.

As shown in FIG. 29, a fixing jig 33C includes a metal fitting 95 at the distal end 63. The metal fitting 95 is used to fix the second end 30*b* of the support plate 30 to the distal end 63 of the arm 61. The metal fitting 95 is rotationally provided on the arm 61. The metal fitting 95 includes a metal fitting body 96 and a lever 97 that rotates the metal fitting body 96. The metal fitting body 96 includes a shaft 96*a* and a hook 96*b* that is orthogonal to the shaft 96*a*. The metal fitting body 96 is rotated such that the hook 96*b* does not get caught on the second end 30*b* of the support plate 30. In this state, the metal fitting body 96 is inserted through the opening 47 of the support plate 30 so that the support plate 30 is arranged below the arm 61. With the support plate 30 arranged below the arm 61, the metal fitting 95 is rotated to engage the hook 96*b* with the second end 30*b* of the support plate 30. In this manner, the second end 30*b* of the support plate 30 is fixed to the distal end 63 of the arm 61.

In this configuration, when the support plate 30 is supported by the fixing jig 33C, the fixing jig 33C is readily engaged with the support plate 30 using the engagement member 90. This allows the support plate 30 to be arranged in the formwork 10 efficiently.

A modification of the spacer 31 will now be described with reference to FIGS. 30 and 31.

Figure 30:
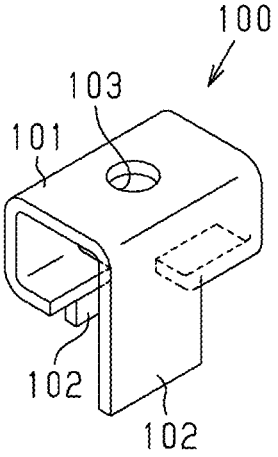
FIG. 30 is a perspective view showing a spacer according to a modification.
Figure 31:
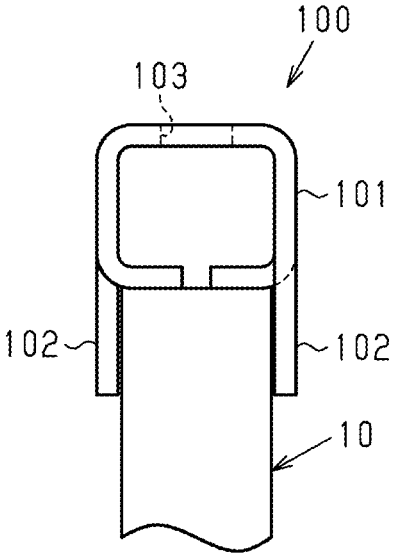
FIG. 31 is a diagram showing the spacer of the modification attached to the formwork.

Referring to FIGS. 30 and 31, a spacer 100 may be attachable to and detachable from the formwork 10. For example, the spacer 100 includes a spacer body 101 and two legs 102 that extend from the spacer body 101. The two legs 102 extend downward from the lower surface of the spacer body 101. The distance between the two legs 102 is equal to the width of the formwork 10. The spacer body 101 includes an insertion hole 103 through which a screw is inserted. The spacer 100 is made of, for example, sheet metal. In this configuration, the spacer 100 is attachable to and detachable from the formwork 10, and includes the insertion hole 103, through which the screw is inserted. This reduces the deformation of the spacer 100 due to the driving of the screw, allowing the spacer 100 to be used repeatedly.

REFERENCE SIGNS LIST

DX) Distance; 1) Foundation; 7) Anchor; 10) Formwork; 11*a*) Outer Surface; 15) Formwork Set; 20) Anchor Support; 30) Support Plate, 30*a*) First End; 30*b*) Second End; 31) Spacer; 33) Fixing Jig; 33A) Fixing Jig; 33B) Fixing Jig; 33C) Fixing Jig; 34) Support Portion; 40) Reference Position; 42) Fastening Portion; 45) Additional Support Plate; 49) Anchor Hole; 60) Body; 61) Arm; 62) Base Portion; 63) Distal End; 65) Fastening Portion; 75) Spacer; 90) Engagement Member; 92) Spacer; 100) Spacer

The invention claimed is:

1. An anchor support that supports an anchor configured to be arranged on a foundation, the anchor support comprising:

a support plate including at least one support portion that supports the anchor arranged in a formwork of the foundation, the support plate being arranged so that a lower surface faces downwardly;

a spacer that is arranged on an upper end surface of the formwork, the spacer positioning the support plate relative to the formwork in a height direction; and a fixing jig that fixes the support plate to the formwork, wherein:

the support plate includes a first end and a second end in a width direction that is orthogonal to a longitudinal direction of the support plate, and the first end or the second end of the support plate is arranged on the spacer so that the fixing jig supports the support plate in a state in which the support plate is arranged at a higher position than the upper end surface of the formwork with the spacer located in between.

2. The anchor support according to claim 1, wherein the fixing jig includes:

a body configured to be arranged along an outer surface of the formwork and fixed to the formwork; and an arm that extends from the body along an upper surface of the support plate and supports the support plate.

3. The anchor support according to claim 2, wherein the arm includes a fastening portion to which the support plate is fastened.

4. The anchor support according to claim 2, wherein:

the arm of the fixing jig includes:

a base portion configured to be connected to an upper part of the body of the fixing jig; and a distal end on a side of the arm opposite to the base portion, and when the body of the fixing jig is arranged along the outer surface of the formwork and the arm supports the support plate, the distal end is configured to be engaged with the second end of the support plate on a side opposite to the first end in the width direction, the first end being configured to be positioned on a side of the support plate closer to the formwork.

5. The anchor support according to claim 2, wherein:

the arm of the fixing jig includes:

a base portion configured to be connected to an upper part of the body of the fixing jig; and a distal end on a side of the arm opposite to the base portion, and when the body of the fixing jig is arranged along the outer surface of the formwork and the arm supports the support plate, the distal end is configured to be secured to the second end of the support plate on a side opposite to the first end in the width direction using an engagement member, the first end being positioned on a side of the support plate closer to the formwork.

6. The anchor support according to claim 1, wherein:

the support portion includes at least one anchor hole through which the anchor is inserted, and in the support portion, the anchor hole is located at a predetermined position relative to a reference position of the support portion.

7. The anchor support according to claim 1, wherein:

the support portion of the support plate is one of support portions, and the support portions of the support plate are spaced apart from each other by a predetermined distance.

8. The anchor support according to claim 1, further comprising an additional support plate that is overlapped with the support plate, wherein the additional support plate includes a support portion that has the same structure as the support portion of the support plate.

9. A formwork set for a foundation, the formwork set comprising the anchor support according to claim 1.

* * * * *